US006206546B1

(12) United States Patent
Krogman

(10) Patent No.: US 6,206,546 B1
(45) Date of Patent: Mar. 27, 2001

(54) LIGHT FIXTURE WITH IMPROVED SEALING FEATURES

(75) Inventor: Mark J. Krogman, Southlake, TX (US)

(73) Assignee: Greenlee Lighting, Carrollton, TX (US)

( * ) Notice: Subject to any disclaimer, the term of this patent is extended or adjusted under 35 U.S.C. 154(b) by 0 days.

(21) Appl. No.: 09/238,335

(22) Filed: Jan. 27, 1999

(51) Int. Cl.[7] ..... F21V 31/02
(52) U.S. Cl. ..... 362/267; 362/310; 362/375
(58) Field of Search ..... 362/267, 310, 362/294, 373, 374, 375

(56) References Cited

U.S. PATENT DOCUMENTS

| | | |
|---|---|---|
| 34,476 | 2/1862 | Bliss . |
| Re. 34,709 | 8/1994 | Tyson . |
| 1,325,619 | 12/1919 | Clemmans . |
| 1,879,263 | 9/1932 | Huffschmidt . |
| 1,968,072 | 7/1934 | Creighton . |
| 2,052,394 | 8/1936 | Fullman . |
| 2,970,209 | 1/1961 | Glowzinski et al. . |
| 3,171,886 | 3/1965 | Holt et al. . |
| 3,193,674 | 7/1965 | Fleming . |
| 3,213,273 | 10/1965 | Zagel . |
| 3,360,642 | 12/1967 | DeVos et al. . |
| 3,679,892 | 7/1972 | Shearer . |
| 3,786,248 | 1/1974 | Compton . |
| 3,864,562 | 2/1975 | Hawkins . |
| 4,041,306 | 8/1977 | Compton et al. . |
| 4,064,432 | 12/1977 | Compton et al. . |
| 4,079,559 | 3/1978 | Tenbrummeler . |
| 4,118,767 | 10/1978 | Urbanek . |
| 4,131,867 | 12/1978 | Quiogue . |
| 4,143,413 | 3/1979 | Kelly . |
| 4,231,080 | 10/1980 | Compton . |
| 4,290,098 | 9/1981 | Pierson . |
| 4,344,118 | 8/1982 | Rundquist et al. . |

(List continued on next page.)

OTHER PUBLICATIONS

Bronzelite–Genlyte, *Tree Lighting*, Bronzelite–Genlyte Sales Brochure, 3 pgs.
Hadco–Genlyte, *H.I.D. Bullytes*, Hadco–Genlyte Sales Brochure, 4 pgs.
Hubbell, *Lightscaping Accessory Guide*, Hubbell Sales Brochure, 3 pgs.
Hydrel, *Accent Lights—All Purpose Performers*, Hydrel Sales Brochure, 5 pgs.
Kim Lighting, *Accent Lights*, Kim Lighting Sales Brochure, 5 pgs.

*Primary Examiner*—Thomas M. Sember
(74) *Attorney, Agent, or Firm*—Wood, Herron & Evans, L.L.P.

(57) ABSTRACT

A light fixture for outdoor use comprises a housing defining an interior space therein and having an open end. The housing interior space is configured for containing a lamp bulb to shine a beam out of the open end of the housing, and the open end includes a sealing face. A radial groove is formed in the housing proximate the housing open end, and includes a cam surface configured to slope in an axial direction along the housing. A retention ring is configured for surrounding the housing open end and is axially movable along the housing. The retention ring includes a retention surface configured to oppose the sealing face. A lens is configured to fit over the open end of the housing to close the housing and has an outer edge positionable between the sealing face and the retention surface of the retention ring for securing the lens to the housing. A cam following structure is coupled to the retention ring, and is operable for engaging the radial groove cam surface and axially moving the retention surface against the housing sealing face to capture the lens outer edge and seal the housing.

17 Claims, 2 Drawing Sheets

U.S. PATENT DOCUMENTS

| | | |
|---|---|---|
| 4,388,677 | 6/1983 | Druffel . |
| 4,399,497 | 8/1983 | Druffel . |
| 4,405,974 | 9/1983 | Quiogue . |
| 4,432,045 | 2/1984 | Merritt . |
| 4,453,203 | 6/1984 | Pate . |
| 4,471,416 | 9/1984 | Druffel . |
| 4,473,873 | 9/1984 | Quiogue . |
| 4,489,368 | 12/1984 | Sangiamo et al. . |
| 4,499,527 | 2/1985 | Tauber et al. . |
| 4,510,557 | 4/1985 | Tsuyama . |
| 4,511,113 | 4/1985 | Druffel et al. . |
| 4,521,836 | 6/1985 | Puttemanns et al. . |
| 4,564,890 | 1/1986 | Poyer . |
| 4,566,057 | 1/1986 | Druffel . |
| 4,595,971 | 6/1986 | Dean . |
| 4,651,260 | 3/1987 | Lasker . |
| 4,694,382 | 9/1987 | Sales . |
| 4,701,832 | 10/1987 | Lasker . |
| 4,713,737 | 12/1987 | Lasker et al. . |
| 4,760,511 | 7/1988 | Russello et al. . |
| 4,763,233 | 8/1988 | Poyer . |
| 4,768,139 | 8/1988 | Poppenheimer . |
| 4,789,923 | 12/1988 | Sales . |
| 4,870,548 | 9/1989 | Beachy et al. . |
| 4,907,139 | 3/1990 | Quiogue . |
| 4,931,914 | 6/1990 | Quiogue . |
| 4,931,915 | 6/1990 | Quiogue . |
| 4,947,307 | 8/1990 | Quiogue . |
| 5,016,151 | 5/1991 | Mula . |
| 5,072,344 | 12/1991 | Fabbri . |
| 5,075,831 | 12/1991 | Stringer et al. . |
| 5,086,379 | 2/1992 | Denison et al. . |
| 5,122,936 | 6/1992 | Guthrie . |
| 5,149,282 | 9/1992 | Donato et al. . |
| 5,183,330 | 2/1993 | Rishel et al. . |
| 5,183,331 | 2/1993 | Edgell et al. . |
| 5,207,499 | 5/1993 | Vajda et al. . |
| 5,211,473 | 5/1993 | Gordin et al. . |
| 5,222,800 | 6/1993 | Chan et al. . |
| 5,249,109 | 9/1993 | Denison et al. . |
| 5,249,110 | 9/1993 | Russello et al. . |
| 5,251,118 | 10/1993 | Budnovitch et al. . |
| 5,258,898 | 11/1993 | Thornton . |
| 5,260,860 | 11/1993 | Jordan et al. . |
| 5,267,759 | 12/1993 | Prokop et al. . |
| 5,289,357 | 2/1994 | Fabbri . |
| 5,307,254 | 4/1994 | Russello et al. . |
| 5,309,341 | 5/1994 | Russello et al. . |
| 5,311,416 | 5/1994 | Maurice . |
| 5,317,493 | 5/1994 | Muller et al. . |
| 5,339,234 | 8/1994 | Russello et al. . |
| 5,349,510 | 9/1994 | Jordan et al. . |
| 5,374,812 | 12/1994 | Chan et al. . |
| 5,381,322 | 1/1995 | Humphreys . |
| 5,386,356 | 1/1995 | Davis, Jr. et al. . |
| 5,394,316 | 2/1995 | Holbrook et al. . |
| 5,408,397 | 4/1995 | Tyson . |
| 5,651,606 | 7/1997 | Krogman . |

LIGHT FIXTURE WITH IMPROVED SEALING FEATURES

FIELD OF INVENTION

The present invention relates generally to light fixtures and specifically to outdoor light fixtures which are exposed to the environment and are utilized as floodlights or spotlights to accent buildings and other structures.

BACKGROUND OF INVENTION

Outdoor light fixtures are utilized for a variety of purposes, such as spotlights or floodlights to illuminate a chosen area or to accent a building or some other structure. For example, outdoor light fixtures are used around houses to shine generally on the front facade of the house and thereby accent the architectural features of the house. Outdoor lights are also utilized at the base of trees, flagpoles and other environmental structures, to illuminate and accent the structures for decorative purposes. Such lighting is often referred to as uplighting. Outdoor light fixtures are also utilized to illuminate more remote areas for the purpose of safety.

Outdoor light fixtures are exposed to the environment due to their usage. Therefore, such fixtures are generally constructed to withstand moisture, such as dew, rain, or water from a sprinkler system. The construction of an outdoor light fixture generally comprises a partially closed housing, open at one end. The housing holds a lamp bulb which shines a beam out of the open end of the housing onto the illuminated structure. In some fixtures, a transparent glass lens is placed over the open end of the housing to close and seal the housing such that water and moisture cannot enter and affect the operation of the lamp. While various available light structures are sealed to keep water from entering, and do so adequately, they have other drawbacks.

For example, many existing light fixtures utilize circular sealing rings which surround the periphery of the open end of the light fixture housing. The sealing rings are utilized in conjunction with circular gaskets. A peripheral lip is formed around the open end of the housing and the circular sealing ring is bolted to the front lip of the housing with bolts which extend generally perpendicular to the lens plane or sealing plane. The gasket is captured between the sealing ring and the housing to seal the housing. Utilizing such sealing rings around the periphery of the housing increases the outer diameter of the open end or front end of the light fixture. The larger front end profile of the fixture is not particularly aesthetically appealing. Since outdoor light fixtures are often visible, and a particular installation may utilize a large number of such fixtures, the aesthetic effect of the light fixture is a relevant consideration.

Furthermore such peripheral sealing designs increase the manufacturing costs of the light fixture by increasing the number of precision machined parts which must be properly seated in order for the fixture to withstand the exposure to rain, dew, or sprinkler water Furthermore the construction and installation of such light fixtures is generally more complicated because of the required alignment between the various sealing, gasket, and housing lip elements.

Accordingly, there is a need in the art for an aesthetically pleasing outdoor light fixture which is more streamlined and smaller in profile than existing fixtures and which effectively prevents large amounts of moisture from entering the fixture housing.

There is a further need in the art to provide a durable, outdoor light fixture which addresses the above need for a water-resistant light fixture and is relatively inexpensive to manufacture.

There is still a further need in the art for an uncomplicated outdoor light fixture which is readily constructed and installed without requiring tedious alignments between the various elements of the fixture.

SUMMARY OF INVENTION

The aforementioned needs in the prior art are addressed by the present invention which comprises a light fixture use comprising a housing that defines an interior space therein. The housing has an open end with a sealing face and the interior space is configured to contain a lamp bulb to shine a beam out of the open end of the housing. A retention ring is configured for surrounding the housing open end and is axially movable with respect to the housing and along the length of the housing. The retention ring includes a retention surface configured to oppose the sealing face of the housing. A transparent lens, for example a flat lens or a convex lens, is configured to fit over the open end of the housing to close the housing while allowing a portion of the light beam to pass therethrough. The lens has an outer edge which is positionable between the sealing face of the housing and the retention surface of the retention ring to secure the lens to the housing and thereby seal the housing.

A radial groove is formed in the housing proximate the housing open end. The radial groove may extend continuously around the housing or may comprise a plurality of end-to-end grooves in a non-continuous arrangement. The radial groove includes a cam surface configured to slope in an axial direction along the housing. In a preferred embodiment of the invention, the radial groove is positioned rearwardly of the housing sealing face and the cam surface slopes in a rearward axial direction. A cam following structure is coupled to the retention ring and is operable for engaging the radial groove cam surface and axially moving the retention ring to move the retention surface against the housing sealing face to capture the lens outer edge and thereby seal the housing.

In one embodiment of the invention, the cam following structure is a series of threaded bolts or screws which are positioned within threaded radial apertures around the retention ring. The threaded bolts thereby engage the groove at various positions around the open end of the housing. Each bolt has a portion which follows the cam surface of the groove and when the bolts are tightened or threaded into the radial apertures of the retention ring, they engage the cam surface and direct the retention ring axially along the housing. In that way, the retention surface of the retention ring is moved against the opposing sealing face of the housing to capture the lens and thereby seal the housing with the lens.

In one embodiment of the invention, a seal is utilized around the outer peripheral edge of the lens and is compressed between the retention ring, retention surface, the lens, and the sealing face of the housing. For example, a seal having a U-shaped cross section may be utilized around the edge of the lens and will provide a seal portion which is coupled between the retention surface and the lens, and also a portion which is coupled between the lens and the sealing face. Furthermore, a portion of the seal is also coupled between an annular surface of the lens and another surface of the retention ring to provide a complete seal around the edge of the open end of the housing to deter and generally prevent water or moisture from entering into the open end of the sealed housing.

As another feature of the invention, a flexible diaphragm surrounds the base of the bulb and is mounted on a ring which is fitted into a groove inside the housing. Apertures are positioned proximate the groove such that moisture is directed away from the bulb by the diaphragm and is drained out of the housing through the apertures. In that way, the light fixture is further protected from the elements and might also be used without a lens or seal with a suitable weather-resistant bulb, such as a PAR bulb.

BRIEF DESCRIPTION OF THE FIGURES

The accompanying drawings, which are incorporated in and constitute a part of this specification, illustrate embodiments of the invention and, together with a general description of the invention given below, serve to explain the principles of the invention.

DETAILED DESCRIPTION OF THE INVENTION

The present invention addresses the above objectives and other objectives by disclosing a light fixture which is sealed with a front end lens in an aesthetically pleasing fashion and is sealed without a large number of expensive precision components. The fixture may be easily assembled and sealed and is relatively inexpensive to manufacture.

Figure 1:
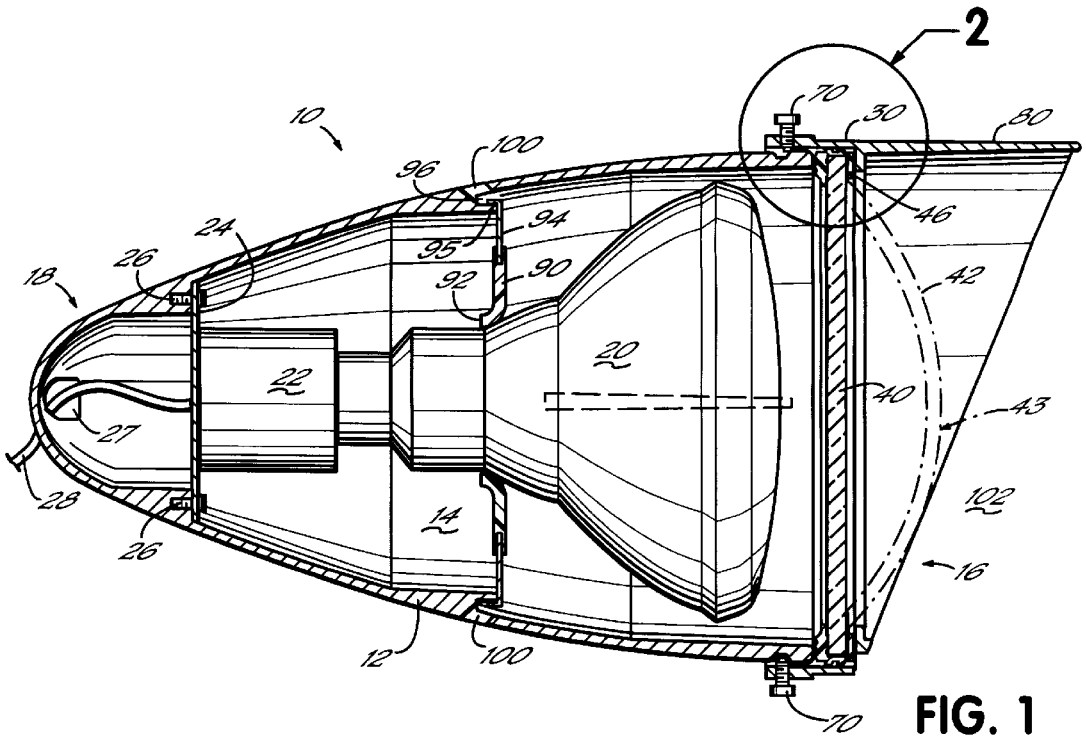
FIG. 1 is a side cross-sectional view of a light fixture in accordance with the principles of the present invention.

To that end, FIG. 1 discloses a cross-section of one embodiment of the invention wherein the light fixture 10 includes a housing 12 defining an interior space 14 therein. The light fixture 10 is primarily designed as an outdoor fixture, but could be used indoors as well. The inventive features of the invention apply to light fixtures, whether used as indoor or outdoor fixtures. The housing 12 is formed of a suitable material such as a die-cast aluminum which is durable and able to withstand the abuse of the outdoor elements. The housing has an open end 16 and, in the embodiment illustrated in the figures, the housing 12 tapers from the open end down to a smaller rear end 18, in a shape often referred to in the industry as a bullet shape. The interior space 14 is configured for containing a lamp bulb 20 which is operable to shine a beam of light (not shown) out of the open end 16 of the housing 12. Generally, to prevent the effects of the outdoor elements, such as moisture due to rain, lawn sprinklers, and dew, the open end 16 of the housing is sealed. As noted above, traditional sealing structures have been unappealing from an aesthetic perspective while requiring numerous precision and expensive sealing structures which not only increase the size of the fixture but also increase its manufacturing and installation costs.

For holding the lamp bulb 20, a socket 22 is secured to a plate 24 which, in turn, is secured to the housing by appropriate fasteners, such as screws 26. An opening 27 in the rear end 18 of housing 12 allows the passage of an appropriate electrical cord 28 which is suitably coupled to a supply of power for powering the lamp bulb 20, as is conventional in light fixtures similar to the light fixture 10 disclosed herein.

Once the light bulb 20 is screwed into the socket 22, the light fixture 10 may be sealed for protection of the bulb 20, socket 22, and other electrical components from outdoor elements such as water, which may come from a variety of sources as discussed above.

Figure 2:
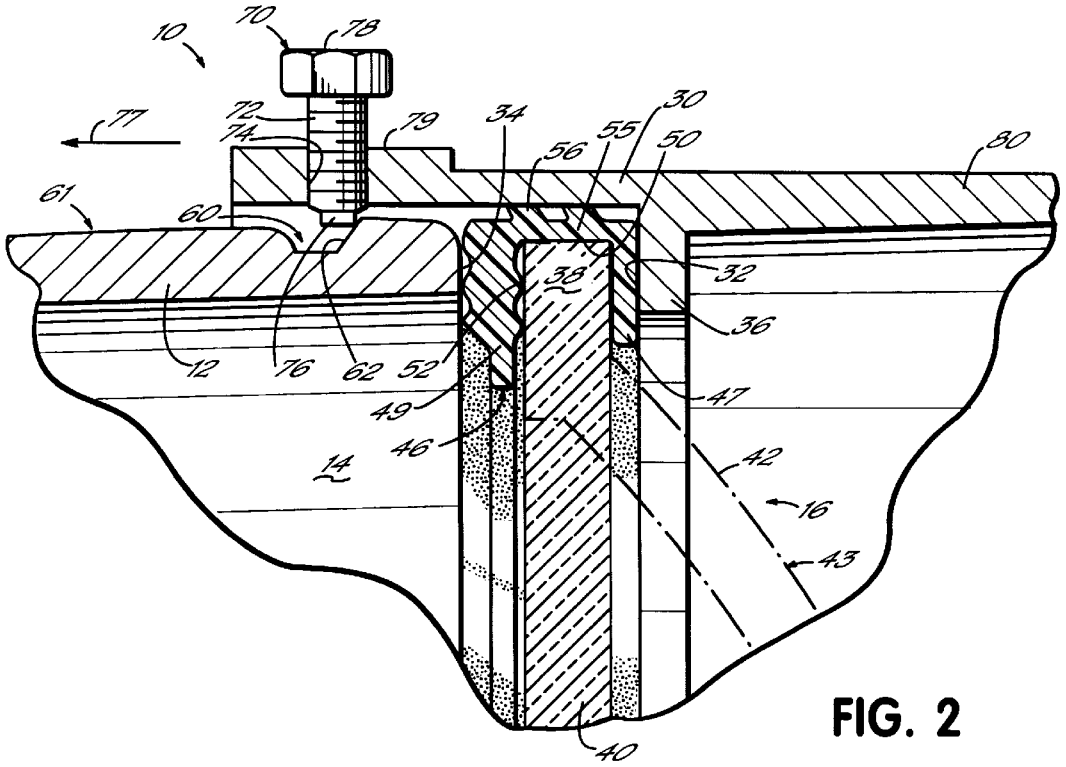
FIG. 2 is a partial cross-sectional view of the fixture of FIG. 1, illustrating the unique sealing assembly of the present invention in a generally unsealed condition.

Referring to FIG. 2, a unique sealing assembly, in accordance with the principles of the present invention, is shown. Specifically, a retention ring 30 engages the housing 12 in a unique fashion to provide a smaller, more streamlined and aesthetically pleasing light fixture which may be inexpensively manufactured and assembled. The retention ring 30 is generally a cylindrically-shaped ring which is configured for surrounding the open end 16 of housing 12. The cylindrically-shaped retention ring 30 is sized to have a larger inner diameter than the outer diameter of the housing 12 proximate the open end 16 of the housing. In that way, retention ring 30 is configured to be axially movable along the length of housing 12. The retention ring 30 may be formed of a suitable material, such as die-cast aluminum. Retention ring 30 includes a retention surface 32 which is positioned to oppose a sealing face 34 formed on the housing 12. As discussed further below, a lens is held between the retention surface 32 and the sealing face 34 to seal the light fixture housing 12.

In the embodiment illustrated in the figures, the retention surface 32 is formed by a radial lip 36 extending inwardly on the retention ring. The radial lip 36 extends radially inwardly of the retention ring to overlap an outer edge 38 of a lens 40 or 42, which is secured to the open end of the housing 12 to seal the housing. Specifically, the lens 40, 42 is configured to fit over the end 16 of the housing to close or seal the housing. The lens 40, 42 is formed of a transparent material, such as glass, and allows a portion of the light beam from bulb 20 to pass therethrough, as is conventional in such light fixtures. In one embodiment of the invention, the lens might be a generally flat lens 40. Alternatively, a lens 42 having a convex portion 43 might also be utilized. Lens 42, having a convex portion 43, includes an outer edge 38 which is configured to be captured between retention surface 32 and sealing face 34. When the retention ring 30 moves axially along the housing 12, the radial lip 36 and retention surface 32 also move axially. Therefore, when the retention ring is moved in a rearward direction with respect to housing 12 (see arrow 77), the radial lip 36 and retention surface 32 are also moved in a rearward direction toward the sealing face 34 of the housing.

Figure 3:
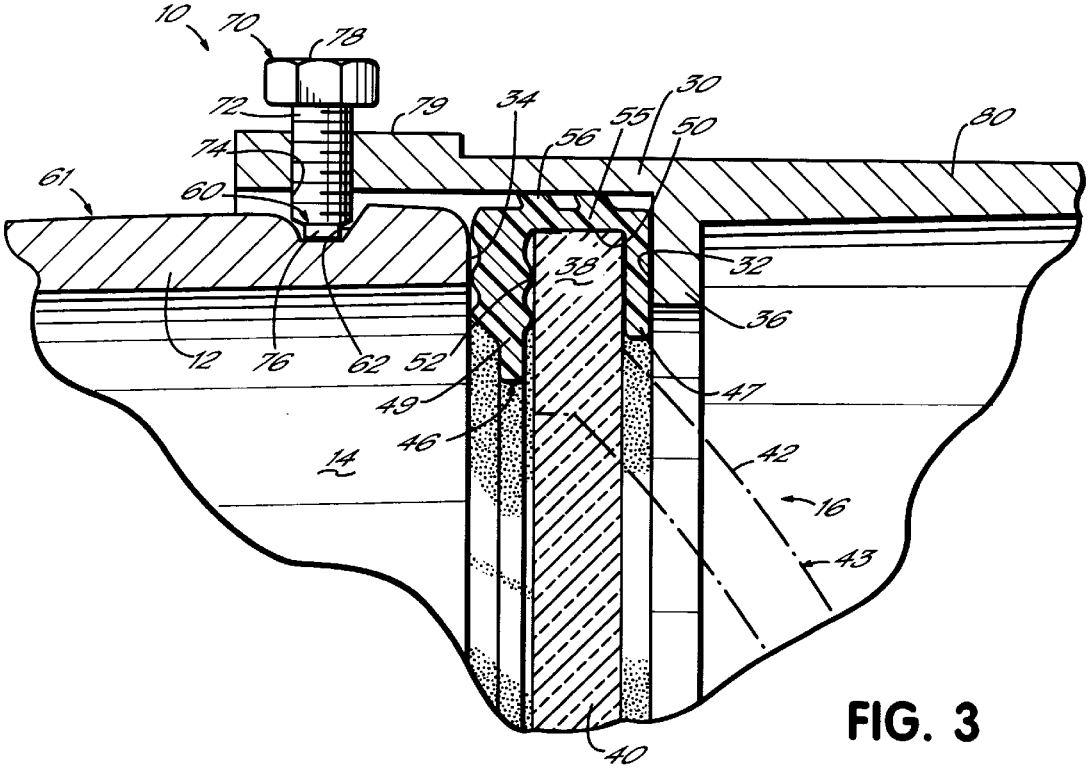
FIG. 3 is a partial cross-sectional view similar to FIG. 2, illustrating the unique sealing assembly of the present invention in a sealed state.

A seal is preferably positioned around the outer edge 38 of the lens 40, 42 and is positioned between the retention ring 30 and the housing 12 for sealing the housing. In one embodiment of the invention, the seal 46 has an O-ring shape and is a compression molded silicone rubber gasket having a generally U-shaped cross section. As illustrated in FIGS. 2 and 3, the U-shaped cross section provides a seal body which surrounds the outer edge 38 of the lens 40, 42. Therefore, the seal 46 has a portion 47 thereof positioned between the lens 40, 42 and the retention surface, and has a portion 49 thereof positioned between the lens 40, 42 and the sealing face 34. In one preferred embodiment of the seal, as shown in the figures, the seal 46 includes portions positioned between the face surfaces of the outer edge 38 of the lens 40, 42 and each of the retention surface 32 and sealing face 34, simultaneously. Seal 46 also includes a portion 51 positioned between the retention ring 30 and an annular surface 50 of the outer edge 38 of the lens 40, 42. The embodiment of the seal illustrated herein has a thicker seal portion 49 positioned between the lens edge 38 and the sealing face 34 than the portion 47 positioned between the lens edge 38 and the retention surface 32. Portion 49 is compressed so that a proper seal may be achieved for housing 12. The opposing surfaces 52 of seal portion 49 are rippled for providing a radial lengthening of seal portion 49 when it is compressed between the edge 38 of the lens 40, 42 and the sealing face 34. This provides a more effective seal at the sealing face 34 by lengthening the seal 46 at the face 34 during compression. Portion 55 of the seal positioned between the annular surface 50 and retention ring 30 includes a plurality of extending fins 56 which further prevent moisture from entering the sealed housing 12. The fins 56 are pressed against ring 30 when the seal 46 is compressed, as discussed hereinbelow.

In accordance with one aspect of the present invention, housing 12 includes a radial groove 60 formed therein. The radial groove 60 is formed in the housing proximate the open end 16. The radial groove is essentially formed in an outer surface 61 of the housing proximate the open end 16 and extends radially inwardly toward the interior space 14, The radial groove 60 includes a cam surface 62 configured to slope in an axial direction along the housing. In the embodiment of the invention illustrated in the figures, the cam surface 62 slopes in a rearward axial direction away from the open end 16 of the housing and toward the rear end 18 of the housing, as illustrated by reference arrow 77. In one embodiment of the invention, the groove is continuous and extends completely around the open end of housing 12. In another embodiment, a plurality of end-to-end radial grooves might be spaced around the housing in a non-continuous fashion.

To move the retention ring 30 with respect to housing 12, a cam following structure, such as a threaded bolt 70, is utilized to engage the radial groove cam surface 62. Specifically, bolt 70 includes a threaded body 72 which engages a threaded aperture 74 formed in the retention ring rearwardly of the retention surface 32. The cam following structure 70 includes an end portion 76 which engages the radial groove cam surface 62 when the cam following structure 70 is threaded inwardly in a radial direction in the aperture 74. That is, when the cam following structure 70 is rotated to thread the structure radially inwardly toward housing 12, portion 76 follows the cam surface 62 and directs the cam following structure and the retention ring 30 in a rearward axial direction with respect to housing 12, as defined by arrow 77. In that way, the retention surface 32 is axially moved in a rearward direction and toward the housing sealing face 34. The lens 40, 42 is captured by retention surface 32 proximate the outer edge 38. The outer edge 38 of the lens 40, 42 is thereby directed against the sealing face 34 to seal housing 12. More specifically, the retention surface 32 acts on the lens 40, 42 and seal 46 to compress a portion 49 of the seal between the outer lens edge 38 and sealing face 34. Furthermore, portion 47 is also compressed between retention surface 32 and the outer edge 38. The fins 56 are directed against the retention ring 30. In that way, the housing 12 is sealed and moisture in the form of dew, rain, or sprinkler water is generally prevented from entering housing 12 proximate the open end 16 thereof. Preferably, at least two cam following structures are utilized to secure the retention ring to the housing, and are positioned approximately 180° apart. Of course, a greater number of cam following structures might also be utilized.

FIG. 3 shows the seal 46 compressed between the housing 12, retention ring 30 and lens 40,42. The cam following structure 70 is threaded toward groove 60 so that the end portion 76 follows cam surface 62 all of the way down the slope to seat in the bottom of the groove and thereby seal the housing. The slope of cam surface 62 may be varied to provide a gradual or more rapid compression of seal 46 when the structure 70 is moved into the position shown in FIG. 3. Furthermore, the distance of surface 62 in the rearward direction 77 may be varied as necessary to provide the proper amount of compression to seal 46 when structure 70 is seated in the groove 60.

The present invention eliminates the need for a flat retention ring which extends radially outwardly from the outer edge of the lens and housing open end 16 and which increases the overall diameter of the front end of the housing. Rather, the cylindrically-shaped retention ring 30 extends along the housing and is dimensioned in thickness to provide a streamlined and aesthetically pleasing look to the assembled housing. The outer diameter of ring 30 may only be slightly larger than the outer diameter of housing 12. A cam following structure, such as the bolt or screw illustrated in the figures is tightened downwardly against the housing to provide the desired sealing force against lens 40, 42 and the seal 46 in accordance with the principles of the present invention. The cam following structure might also be dimensioned such that when fully tightened to seal the housing, the head 78 lies flush against the surface 79 of the retention ring to further promote a streamlined look to the light fixture. In one embodiment of the invention, multiple cam following structures 70 are utilized around the length of the groove 60 and around housing 12 for an even seal.

In accordance with another aspect of the present invention, as illustrated in FIG. 1, retention ring 30 includes a shield portion 80 which extends forwardly in a forward axial direction with respect to housing 12 to provide a shield to the lens 40, 42 and the beam from bulb 20 which passes through the lens. The shield portion 80 may be in any suitable shape, as is conventional in the art.

For the most efficient and even seal, the retention ring should be machined with suitable precision and the lens 40, 42 should have close tolerances. Furthermore, the cam following structure should be specially constructed to provide for smooth camming and axial movement of the retention ring 30 when the cam following structure is axially moved or tightened within the housing groove 60.

In the embodiment of the invention illustrated in the figures, the groove 60 is positioned rearwardly of the sealing face. Alternatively, the groove 60 might be positioned forwardly of the sealing face. In accordance with one aspect of the present invention, regardless of the groove 60 positioning with respect to the sealing surface 34, the cam following structure 70 is operable for engaging the radial groove cam surface 62 and axially moving the retention surface 32 against the housing sealing face 34 to capture the lens 40, 42 and compress seal 46, and thereby seal the housing 12.

For further preventing moisture from reaching socket 22 of the light fixture 10, a flexible diaphragm 90 surrounds the base of bulb 20 when the bulb is secured in the socket. Diaphragm 90 is preferably formed of a flexible sealing material, such as rubber, and has an opening 92 for receiving the socket end of bulb 20. The aperture 92 is dimensioned to allow diaphragm 90 to seal against the bulb as shown in FIG. 1 to prevent moisture in the interior space forward of diaphragm 90 from reaching the socket 22 which is rearward of diaphragm 90. The diaphragm directs moisture away from the bulb and toward an annular groove 96 in the interior space of the housing. The diaphragm 90 is mounted on a ring 94 which has an annular lip 95 which is press fit into the groove 96 formed around the inside of housing 12. If desired, the ring 30, lens 40, 42 and seal 46 might be removed so that the housing is used in an open fashion, with diaphragm 90 providing the only moisture seal.

To drain the water directed away from the bulb by diaphragm 90, apertures 100 are formed in the housing and generally proximate groove 96 to provide a direct opening between interior space 14 and the outside of the housing. Water directed by the diaphragm 90 into the groove 96 will be drained to the outside of the housing. Such feature is particularly useful if the light fixture is pointed vertically, such as to illuminate the base of a building or tree. In accordance with one aspect of the present invention, the light fixture would be utilized with a bulb 20, such as an arc-discharge type of bulb which must be sealed against the elements. Certain portions of such bulbs would generally crack if exposed to the elements, such as water. However, a parabolic aluminum reflector or PAR lamp might also be utilized wherein the lens 40, 42 could be removed, leaving the housing unsealed. In such a case, water draining into the housing is directed by diaphragm 90 to the groove 96 wherein the water is drained away by the apertures 100. Other durable outside lightbulbs, in addition to PAR bulbs might also be utilized with the present invention. In one embodiment, 4 draining apertures 100 are positioned around the housing approximately 90° from each other. Of course, a greater or lesser number of draining apertures 100 might also be utilized. In that way, diaphragm 90, groove 96 and apertures 100 provide secondary moisture protection for the light fixture to prevent moisture from reaching socket 22 and other electrical components of the light fixture. If the housing is left unsealed by removing the lens 40, 42 and the seal, the diaphragm 90, groove 96 and apertures provide the primary sealing structure for the light fixture. Accordingly, the light fixture provides a versatile fixture which may be utilized with a variety of different bulbs, and for a variety of different outdoor settings and installations.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details representative apparatus and method, and illustrative examples shown and described. Accordingly, departures may be made from such details without departure from the spirit or scope of applicant's general inventive concept.

What is claimed is:

1. A light fixture for outdoor use comprising:

a housing defining an interior space therein and having an open end, the housing interior space configured for containing a lamp bulb to shine a beam out of the open end of the housing, and the open end including a sealing face;

a radial groove formed in an outer surface of the housing proximate the housing open end and rearwardly of the sealing face, the radial groove including a cam surface configured to slope in a rearward axial direction along the housing;

a retention ring configured for surrounding the housing open end and axially movable along the housing, the retention ring including a retention surface configured to oppose the sealing face;

a lens configured to fit over the open end of the housing to close the housing and allow a portion of the beam to pass therethrough, the lens having an outer edge positionable between the sealing face and the retention surface of the retention ring for securing the lens to the housing;

a cam following structure coupled to the retention ring, the cam following structure operable for engaging the rearward-sloping radial groove cam surface and axially moving the retention surface rearwardly against the housing sealing face to capture the lens outer edge and seal the housing.

2. The light fixture of claim 1 wherein said retention ring comprises a radial lip extending therefrom, the radial lip including said retention surface.

3. The light fixture of claim 1 wherein said cam following structure axially moves the retention ring rearwardly along the housing to move the retention surface against the housing sealing surface.

4. The light fixture of claim 1 further comprising a seal having a portion thereof positioned between said lens and said sealing face for further sealing the housing.

5. The light fixture of claim 1 further comprising a seal having a portion thereof positioned between said lens and said retention surface for further sealing the housing.

6. The light fixture of claim 1 further comprising a seal configured for surrounding the outer edge of the lens, the seal comprising a portion positioned between said lens and said retention surface, and a portion simultaneously positioned between said lens and said sealing face for further sealing the housing.

7. The light fixture of claim 6 wherein said seal is U-shaped for surrounding said lens outer edge.

8. The light fixture of claim 1 further comprising a seal having a portion thereof positioned between said retention ring and an annular surface of said lens.

9. The light fixture of claim 1 wherein said cam following structure includes a threaded bolt extending through a threaded radial aperture in said retention ring, the bolt, when threaded into the aperture, engaging the cam surface and axially moving the retention surface against the housing sealing surface.

10. The light fixture of claim 1 wherein said lens is generally flat.

11. The light fixture of claim 1 wherein said lens has a convex portion.

12. The light fixture of claim 1 wherein said retention ring includes a shield portion to shield said lens.

13. The light fixture of claim 1 further comprising a seal positioned between said retention ring and said housing for further sealing the housing.

14. The light fixture of claim 13 wherein said seal is formed of silicon.

15. The light fixture of claim 1 wherein said radial groove extends continuously around the housing.

16. The light fixture of claim 1 further comprising a diaphragm positioned in the interior space and configured for surrounding the lamp bulb, the housing including a groove formed in the housing interior space, the diaphragm operable for directing moisture toward said groove and away from a bulb.

17. The light fixture of claim 16 further comprising at least one aperture formed proximate the groove for draining moisture from the groove.

* * * * *